US008172382B2

(12) United States Patent
Kanbe et al.

(10) Patent No.: US 8,172,382 B2
(45) Date of Patent: May 8, 2012

(54) CONTAINER ARRANGEMENT INCLUDING INK TANK AND ADAPTER CONFIGURED TO BE MOUNTED TO INK TANK

(75) Inventors: Tomohiro Kanbe, Nagoya (JP); Hirotake Nakamura, Nagoya (JP); Shingo Hattori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 402 days.

(21) Appl. No.: 12/401,861

(22) Filed: Mar. 11, 2009

(65) Prior Publication Data

US 2009/0322834 A1 Dec. 31, 2009

(30) Foreign Application Priority Data

Jun. 30, 2008 (JP) ..... 2008-171812

(51) Int. Cl.
*B41J 2/175* (2006.01)
*B41J 29/393* (2006.01)
*B41J 2/17* (2006.01)

(52) U.S. Cl. ..... 347/86; 347/19; 347/84

(58) Field of Classification Search ..... 347/86
See application file for complete search history.

(56) References Cited

U.S. PATENT DOCUMENTS 5,138,344 A * 8/1992 Ujita ..... 347/86
5,506,611 A 4/1996 Ujita et al.
5,860,363 A * 1/1999 Childers et al. ..... 347/86
6,062,667 A 5/2000 Matsui et al.
6,076,920 A 6/2000 Zapata et al.
6,312,084 B1 11/2001 Ujita et al.
6,764,169 B2 * 7/2004 Hall et al. ..... 347/85
6,786,583 B2 * 9/2004 Ota et al. ..... 347/86
6,880,313 B1 * 4/2005 Gessford et al. ..... 53/442
7,316,471 B2 1/2008 Hattori et al.
7,360,858 B2 4/2008 Hayamizu et al.
7,416,291 B1 * 8/2008 Hattori et al. ..... 347/86
2001/0033315 A1 10/2001 Hatasa et al.
2001/0045977 A1 11/2001 King et al.
2003/0081087 A1 * 5/2003 Sakai et al. ..... 347/86
2003/0085967 A1 * 5/2003 Ota et al. ..... 347/86

(Continued)

FOREIGN PATENT DOCUMENTS

CN 2683375 Y 3/2005

(Continued)

OTHER PUBLICATIONS

The State Intellectual Property Office of the People'S Republic of China; Notification of First Office Action in Chinese Patent Application No. 200810211192.5 (counterpart to the above-captioned U.S. Patent Application) mailed Sep. 13, 2010.

(Continued)

*Primary Examiner* — Shelby Fidler
(74) *Attorney, Agent, or Firm* — Baker Botts L.L.P.

(57) ABSTRACT

A container arrangement includes a packaging arrangement including an ink tank defining an ink chamber therein, in which the ink chamber is configured to store ink therein, and a packaging bag enclosing the ink tank therein. A pressure of an interior of the packaging bag is less than a pressure of an exterior of the packaging bag. The container arrangement also includes an adapter configured to be coupled to the ink tank, and a container enclosing each of the packaging arrangement and the adapter. The adapter is positioned outside the packaging bag.

14 Claims, 13 Drawing Sheets

U.S. PATENT DOCUMENTS

| | | | | |
|---|---|---|---|---|
| 2004/0027432 | A1 | 2/2004 | Childers et al. | |
| 2004/0104984 | A1 | 6/2004 | Hall et al. | |
| 2004/0176735 | A1* | 9/2004 | Snell | 604/385.01 |
| 2005/0168540 | A1 | 8/2005 | Wilson et al. | |
| 2005/0195225 | A1* | 9/2005 | Takagi et al. | 347/7 |
| 2005/0212877 | A1* | 9/2005 | Liang | 347/86 |
| 2005/0275700 | A1 | 12/2005 | Buchanan et al. | |
| 2006/0023040 | A1 | 2/2006 | Castle et al. | |
| 2007/0070141 | A1* | 3/2007 | Hattori et al. | 347/86 |
| 2007/0229615 | A1 | 10/2007 | Hattori et al. | |
| 2007/0279464 | A1* | 12/2007 | Harazim | 347/86 |
| 2008/0198210 | A1* | 8/2008 | Umeda | 347/86 |
| 2008/0239038 | A1* | 10/2008 | Yoshimoto et al. | 347/86 |
| 2009/0135236 | A1* | 5/2009 | Shimoda | 347/86 |
| 2009/0207215 | A1 | 8/2009 | Fost | |
| 2010/0103231 | A1 | 4/2010 | Iwamura et al. | |
| 2010/0289847 | A1 | 11/2010 | Ishizawa et al. | |

FOREIGN PATENT DOCUMENTS

| | | | |
|---|---|---|---|
| CN | 101195302 | A | 6/2008 |
| EP | 1839871 | A | 10/2007 |
| EP | 1839873 | A | 10/2007 |
| EP | 1905596 | A1 * | 4/2008 |
| EP | 2045079 | A1 | 4/2009 |
| JP | H03-213349 | A | 9/1991 |
| JP | 2005-028614 | A | 2/2005 |
| JP | 2007-144811 | A | 6/2007 |
| WO | 9745269 | A | 12/1997 |
| WO | 0119615 | A | 3/2001 |

OTHER PUBLICATIONS

European Patent Office, extended European Search Report for European Patent Application No. 11160606.7 (counterpart to above-captioned patent application), dated May 23, 2011.

European Patent Office, extended European Search Report for European Patent Application No. 11160584.6 (counterpart to above-captioned patent application), dated May 23, 2011.

The State Intellectual Property Office of the People'S Republic of China, Notification of the Second Office Action for Chinese Patent Application No. 200810211194.4 (counterpart to above-captioned patent application), issued Apr. 20, 2011.

European Patent Office, European Search Report for European Patent Application No. 08013451 (counterpart to above-captioned patent application), dated Jan. 15, 2009.

European Patent Office, Office Action for European Patent Application No. 08013451.3 (counterpart to above-captioned patent application), dated May 19, 2011.

European Patent Office, Observations by Third Party concerning European Patent Application No. 08013451.3 (counterpart to above-captioned patent application), dated Apr. 12, 2011.

* cited by examiner

CONTAINER ARRANGEMENT INCLUDING INK TANK AND ADAPTER CONFIGURED TO BE MOUNTED TO INK TANK

CROSS-REFERENCE TO RELATED APPLICATION

The present application claims priority from Japanese Patent Application No. JP-2008-171812, which was filed on Jun. 30, 2008, the disclosure of which is incorporated herein by reference in its entirety.

BACKGROUND OF THE INVENTION

1. Field of the Invention

The present invention relates generally to container arrangements. In particular, the present invention is directed towards container arrangements comprising an ink tank enclosed in a packaging bag, an adapter positioned outside the packaging bag, and a container enclosing the ink tank and the adapter.

2. Description of Related Art

A known inkjet recording apparatus, such as the inkjet recording apparatus described in JP-A-2007-144811, is configured to record an image on a sheet of paper using ink. The known inkjet recording apparatus has a recording head, and the recording head has a plurality of nozzles formed therein. The recording head is configured to selectively eject ink from the nozzles to form an image on a sheet of paper. The known inkjet recording apparatus also has a mounting portion to which a known ink cartridge is removably mounted. The known ink cartridge has an ink chamber configured to store ink therein, and when the ink cartridge is mounted to the mounting portion, ink is allowed to be supplied from the ink chamber to the recording head.

If gas, such as oxygen, is dissolved in ink stored in the ink chamber, the gas may turn into bubbles. Such bubbles may be transferred to the recording head, and may affect the ejection of ink from the nozzles. Another known ink cartridge has an ink chamber configured to store deaerated ink. To maintain the deaerated state of the ink, the ink cartridge is enclosed in a packaging bag which is impervious to gas, and the interior of the packaging bag is depressurized.

Nevertheless, when the interior of the packaging bag is depressurized, a space may be formed by a particular portion of the ink cartridge and a particular portion of the packaging bag. The atmospheric pressure acts on one surface of the particular portion of the ink cartridge via the packaging bag while the pressure in the space is less than the atmospheric pressure. Therefore, the particular portion of the ink cartridge may bend into the space if the rigidity of the ink cartridge is relatively low. When the particular portion of the ink cartridge is bent for a predetermined amount of time in the packaging bag, the particular portion of the ink cartridge may be deformed and may not return to its original shape even after the ink cartridge is removed from the packaging bag.

SUMMARY OF THE INVENTION

Therefore, a need has arisen for container arrangements which overcome these and other shortcomings of the related art. A technical advantage of the present invention is that deformation of an ink cartridge may be prevented.

According to an embodiment of the present invention, a container arrangement comprises a packaging arrangement including an ink tank defining an ink chamber therein, in which the ink chamber is configured to store ink therein, and a packaging bag enclosing the ink tank therein. A pressure of an interior of the packaging bag is less than a pressure of an exterior of the packaging bag. The container arrangement also comprises an adapter configured to be coupled to the ink tank, and a container enclosing each of the packaging arrangement and the adapter. The adapter is positioned outside the packaging bag.

Other objects, features, and advantages of embodiments of the present invention will be apparent to persons of ordinary skill in the art from the following description of embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Embodiments of the present invention and their features and technical advantages may be understood by referring to FIGS. 1-13, like numerals being used for like corresponding portions in the various drawings.

Figure 1:
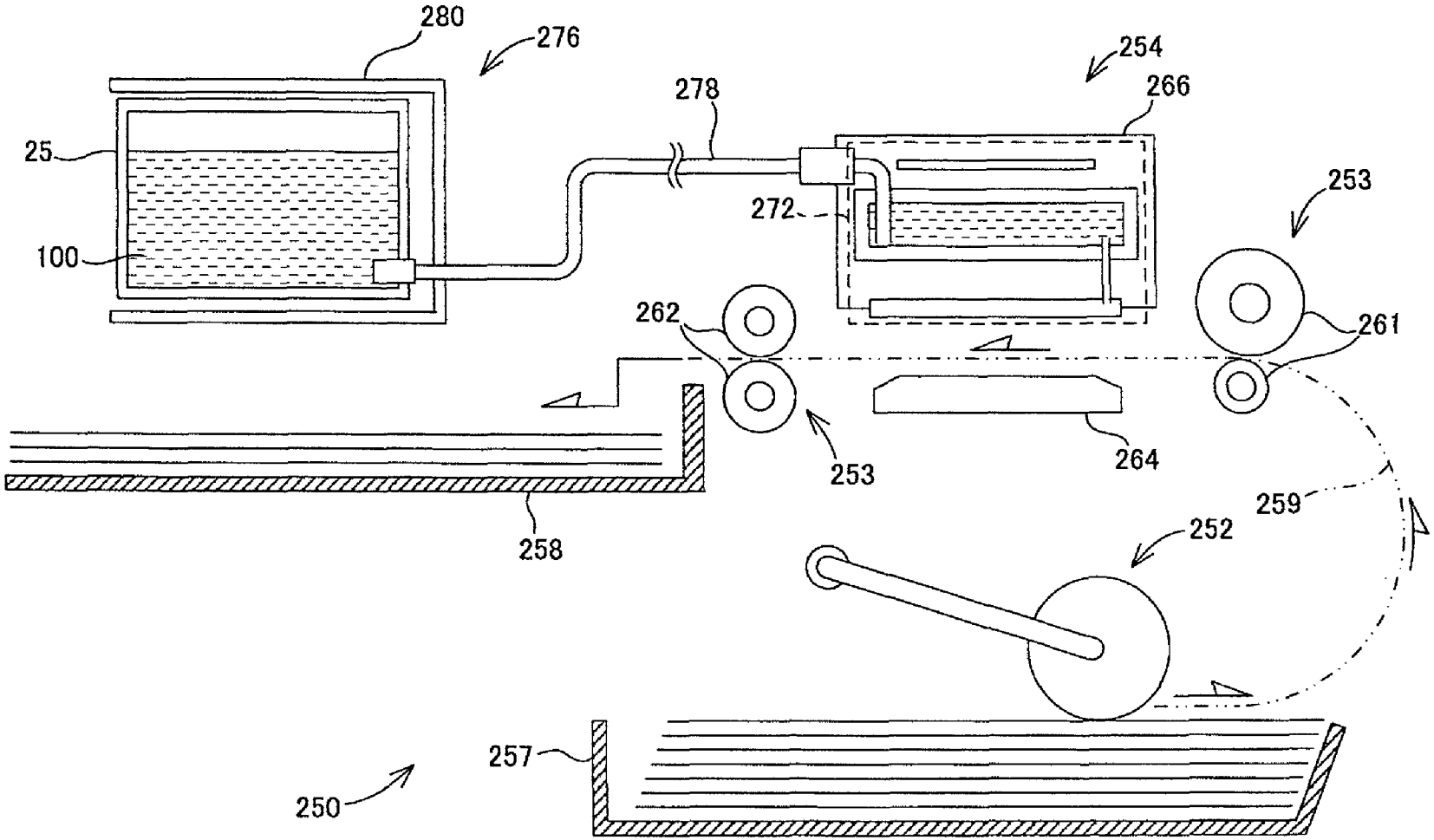
FIG. 1 is a cross-sectional, pattern diagram of a recording apparatus according, to an embodiment of the present invention.

Referring to FIG. 1, an inkjet recording apparatus 250 according to an embodiment of the invention is depicted. Recording apparatus 250 is configured to record an image, e.g., a monochrome image or a color image, on a recording medium, e.g., a sheet of paper, using at least one ink, e.g., four inks, such as a black ink, a yellow ink, a cyan ink, and a magenta ink. Recording apparatus 250 may comprise a feeding device 252, a transferring device 253, a recording device 254, and a cartridge mounting portion 276. Cartridge mounting portion 276 may be configured to receive an ink cartridge. As shown in FIGS. 5-13, the ink cartridge may comprise an adapter 27 and an ink tank 25. Recording apparatus 250 also may comprise a first tray 257 and a second tray 258, and recording apparatus 250 may be a transfer path 259 extending from first tray 257 to second tray 258. Feeding device 252 may be configured to feed sheets of paper accommodated in first tray 257 one by and, to transfer path 259.

Transferring device 253 may comprise a first pair of transfer rollers 261 and a second pair of transfer rollers 262 positioned along transfer path 259. First pair of transfer rollers 261 may be positioned on the upstream side of recording device 254, and second pair of transfer rollers 262 may be positioned on the downstream side of recording device 254 along transfer path 259.

Recording apparatus 250 also may comprise a platen 264 positioned directly below recording device 254. The sheet of paper fed by feeding device 252 may be transferred onto platen 264 by first pair of transfer rollers 261. Recording device 254 may be configured to record an image on the sheet of paper being transferred over platen 264. The sheet of paper having passed over platen 264 may be transferred by second pair of transfer rollers 262 to second tray 258, which may be positioned at the downstream end of transfer path 259.

Recording device 254 may comprise a carriage 266, and a recording head 272 mounted in carriage 266. Carriage 266 may be supported by rails (not shown), such that carriage 266 slides on the rails in a direction perpendicular to the paper plane of FIG. 1. Recoding head 272 may be configured to eject ink onto the sheet of paper.

Cartridge mounting portion 276 may be configured to receive at least one ink tank 25, e.g., four ink tanks each 25 storing a different color ink such as a black ink, a yellow ink, a cyan ink, and a magenta ink, respectively. Cartridge mounting portion 276 also may be configured to receive at least one adapter 27, e.g., four adapters 27 corresponding to four ink tanks 25, respectively. Cartridge mounting portion 276 may be comprise at least one case 280, e.g., four cases 280 corresponding to four ink tanks 25, respectively. Ink tank 25 and adapter 27 may be configured to be inserted into and removed from case 280. Ink tank 25 may comprise an ink chamber 100 defined therein. Ink chamber 100 may be configured to store ink therein. Recording apparatus 250 may comprise at least one flexible tube 278, e.g., four flexible tubes 278 connected to cases 280, respectively, and to recording head 272. When ink tank 25 and adapter 27 are mounted to cartridge mounting portion 276, ink may be supplied from ink chamber 100 to recording head 272 via a corresponding one of tubes 278.

Referring to FIGS. 2(A)-3(B), ink tank 25 may have a substantially rectangular parallelepiped shape. A width of ink tank 25 in a width direction as indicated by an arrow 31, may be relatively short, and each of a height of ink tank 25 in a height direction, as indicated by an arrow 32, and a depth of ink tank 25 in a depth direction, as indicated by an arrow 33, may be greater than the width of ink tank 25. Ink tank 25 may comprise a top outer face 43 and a bottom outer face 44 opposite top outer face 43. When ink tank 25 is mounted to cartridge mounting portion 276, top outer face 43 may be positioned above bottom outer face 44. Ink tank 25 may be configured to be inserted into case 280 in an insertion direction 30, which is parallel to depth direction 33. Ink tank 25 also may comprise a front outer face 41, a rear outer face 42 opposite front outer face 41, a left side outer face 45, and a right side outer face 46 opposite left side outer face 45. Each of front outer face 41 and rear outer face 42 may be connected to top outer face 43 and bottom outer face 44, and each of left side outer face 45 and right side outer face 46 may be connected to front outer face 41, rear outer face 42, top outer face 43, and bottom outer face 44. Front outer face 41, rear outer face 42, top outer face 43, bottom outer face 44, left side outer face 45, and right side outer face 46 may be substantially parallel to its opposing face, and may be substantially perpendicular to its other faces. Each of an area of left side outer face 45 and an area of right side outer face 46 may be greater than each of an area of front outer face 41, an area of rear outer face 42, an area of top outer face 43, and an area of bottom outer face 44. Ink tank 25 may be inserted into case 280 from a front outer face 41 side.

Ink tank 25 also may comprise a frame 50, a pivotable member 70, an air communication portion 80, an ink supply portion 90, a pair of side walls 60. Frame 50 may define front outer face 41, rear outer face 42, top outer face 43, and bottom outer face 44 of ink tank 25. Pair of side walls 60 may be connected to, e.g., attached to, frame 50, and pair of side walls 60 may define left side outer face 45 and right side outer face 46 of ink tank 25, respectively.

Frame 50 may comprise a translucent resin material, e.g., a transparent material or a semi-transparent material, and light, e.g., visible or infrared light, may pass therethrough. In an embodiment, frame 50 may be manufactured by injection-molding polypropylene. Alternatively, frame 50 may be manufactured by injection-molding polyacetal, nylon, polyethylene, or the like. Frame 50 may comprise a detection portion 140 positioned at front outer face 41, and detection portion 140 may comprise the same material as frame 50. Alternatively, substantially an entirety of frame 50 may comprise an opaque resin material, but detection portion 140 may comprise a translucent resin material, e.g., a transparent material or a semi-transparent material, and light, e.g., visible or infrared light may pass therethrough.

Frame 50 may comprise an outer peripheral wall 51 and a plurality of inner walls or inner ribs 52. Inner walls or inner ribs 52 may be positioned inside outer peripheral wall 51. Outer peripheral wall 51 and each of inner walls or inner ribs 52 may be connected to each other via a connecting wall (not shown) extending in a plane parallel to height direction 32 and depth direction 33. Outer peripheral wall 51 and inner walls or inner ribs 52 may extend in width direction 31. Outer peripheral wall 51 may have a substantially square or rectangular profile extending along front outer face 41, top outer face 43, rear outer face 42, and bottom outer surface 44 defining a perimeter of ink chamber 100. Outer peripheral wall 51 may have a thickness extending from an outer face of outer peripheral wall 51, e.g., front outer face 41, rear outer face 42, top outer face 43, and bottom outer face 44, to an inner face of outer peripheral wall 51 facing ink chamber 100 in a direction perpendicular to the outer face and the inner face of outer peripheral wall 51. In an embodiment, the thickness of outer peripheral wall 51 is about 1 millimeter. Frame 50 may have a rigidity which is sufficient to maintain the shape of ink tank 25 when an external force is applied to ink tank 25. For example, the rigidity of frame 50 may be relatively high in the depth direction 33. The rigidity of frame 50 may be greater than the rigidity of adapter 27. When ink tank 25 is enclosed in a packaging bag 128, and an interior of packaging bag 128 may be depressurized. The pressure differential between the interior of packaging bag 128 and an exterior of packaging bag 128 may cause a force to be applied to ink tank 25 via packaging bag 128. Moreover, when an interior of ink chamber 100 is depressurized, the pressure differential between the interior of ink chamber 100 and an exterior of ink chamber 100 may cause a force to be applied to ink tank 25. Nevertheless, in such a situation, ink tank 25 is not substantially deformed because of the rigidity of frame 50. Frame 50 may slightly bend when receiving a force, but frame 50 returns to its original shape when the force is released.

Openings surrounded by peripheral wall 51 may be formed on both ends of frame 50 in width direction 31, respectively. Pair of side walls 60 may be connected to, e.g., adhered to, the ends of frame 50 in width direction 31, respectively, via an adhesion method, e.g., a thermal adhesion method, such that the openings are covered by pair of side walls 60, respectively, and outer peripheral wall 51 and pair of side walls 60 define ink chamber 100 therein. More specifically, pair of side walls 60 may be connected to both ends of outer peripheral wall 51 and both ends of inner walls or inner ribs 52 in width direction 31. Pair of side walls 60 may comprise the same material as frame 50. Pair of side walls 60 may be a pair of translucent films, e.g., transparent or semi-transparent films. Because pair of side walls 60 may be connected to inner walls or inner ribs 52, when a force is applied to pair of side walls 60 toward ink chamber 100, inner walls or inner ribs 52 support pair of side walls 60. Therefore, pair of side walls 60 do not substantially bend and are not substantially deformed toward ink chamber 100. Pair of side walls 60 may slightly bend when receiving the force, but pair of side walls 60 return to its original shape when the force is released. Ink tank 25 may comprise a pair of covers covering pair of side walls 60 to reinforce the rigidity of ink tank 25.

Ink stored in ink chamber 100 may be deaerated, and the interior of ink chamber 100 may be depressurized to maintain the deaerated state of ink. For example, the pressure in the interior of ink chamber may be between −80 kPa and −35 kPa.

An amount of ink stored in ink chamber 100 may be optically or visually detected via detection portion 140. Detection portion 140 may extend outward from a middle portion of front outer face 41 of frame 50 in height direction 32. Detection portion 140 also may extend away from ink chamber 100. Detection portion 140 may comprise five rectangular walls and may have a substantially hollow box shape. For example, detection portion 140 may comprise a front wall 140A, a pair of side walls 140B, a top wall 140C, and a bottom wall 140D. Front wall 140A may extend parallel to front outer face 41 and may be separated from front face 41 by a predetermined distance. Side walls 140B may be connected to front outer face 41 and front wall 140A, top wall 140C may be connected to top ends of front wall 140A and side walls 140B, and bottom wall 140D may be connected to bottom ends of front wall 140A and side walls 140B. Moreover, the width of front wall 140A may be less than the width of front face 41 in width direction 31. Detection portion 140 may be configured to receive light, e.g., visible or infrared light, emitted from an optical sensor 230, e.g., a photo interrupter, positioned in cartridge mounting portion 276. When ink tank 25 is mounted to cartridge mounting portion 276, a light emitting portion of optical sensor 230 faces one of side walls 140B, and a light receiving portion of optical sensor 230 faces the other of the side walls 140B. Light emitted from the light emitting portion of optical sensor 230 may pass through side walls 140B and reach the light receiving portion of optical sensor 230.

Detection portion 140 may have an inner space 142 defined by front wall 140A, side walls 140B, top wall 140C, and bottom wall 140D. There may be no wall positioned between inner space 142 and ink chamber 100 such that inner space 142 is in fluid communication with ink chamber 100. Pivotable member 70 is positioned in ink chamber 100. Pivotable member 70 may comprise an indication portion 72 positioned at a first end of pivotable member 70, and a float 73 positioned at a second end of pivotable member opposite the first end of pivotable member 70. Indication portion 72 may be configured to be positioned in inner space 142. Pivotable member 70 may extend from indication portion 72 to float 73 in a plane substantially parallel to height direction 32 and depth direction 33. Pivotable member 70 may comprise a shaft 66 positioned between indication portion 72 and float 73. Shaft 66 may extend in width direction 31. Both ends of shaft 66 may be supported by bearings (not shown) positioned at inner surfaces of pair of side walls 66, respectively, such that pivotable member 70 pivots about shaft 66. When pair of side walls 60 is a pair of flexible films, the bearings may not be positioned at inner surfaces of pair of side walls 66, and shaft 66 may be supported by the bearings positioned at frame 50.

Pivotable member 70 may comprise an opaque material. Pivotable member 70 may be manufactured by injection-molding a resin, e.g., nylon, polyethylene, polypropylene, polycarbonate, polyolefin, acrylic resin, or the like. A coloring agent, e.g., carbon black, may be added in the resin. Alternatively, at least indication portion 72 may comprise an opaque material, and other portions of pivotable member 70 may comprise a non-opaque material. When indication portion 72 receives light emitted from optical sensor 230, indication portion 72 may block the light. For example, indication portion 72 may prevent the light from passing therethrough or may alter the path of light. Alternatively, pivotable member 70 may comprise a reflective member, e.g., aluminum foil, positioned at indication portion 72, and when indication portion 72 receives light emitted from optical sensor 230, indication portion 72 reflects the light. In another embodiment, indication portion 72 may sufficiently reduce the intensity of light passing therethrough The specific gravity of float 73 may be less than the specific gravity of ink in ink chamber 100. In an embodiment, float 73 has a hollow space formed therein. Float 73 may be configured to move up and down in accordance with an increase and a decrease in the amount of ink in ink chamber 100, respectively. In accordance with the movement of float 73, pivotable member 70 pivots about shaft 66, and in accordance with the pivot movement of pivotable member 70, indication portion 72 moves up and down in inner space 142.

When ink chamber 100 has a sufficient amount of ink stored therein, indicator portion 72 is positioned in a first position in which indicator portion 72 contacts bottom wall 140D, as shown in solid line in FIG. 3. When ink chamber 100 does not have a sufficient amount of ink stored therein, indicator potion 72 is positioned in a second position in which indication portion 72 is separated from bottom wall 140D and contacts top wall 140C. By monitoring whether indicator portion 72 is positioned in the first position from an exterior of detection portion 140, e.g., by optical sensor 230, it may be determined whether ink chamber 100 has a sufficient amount of ink stored therein.

Figure 3B:
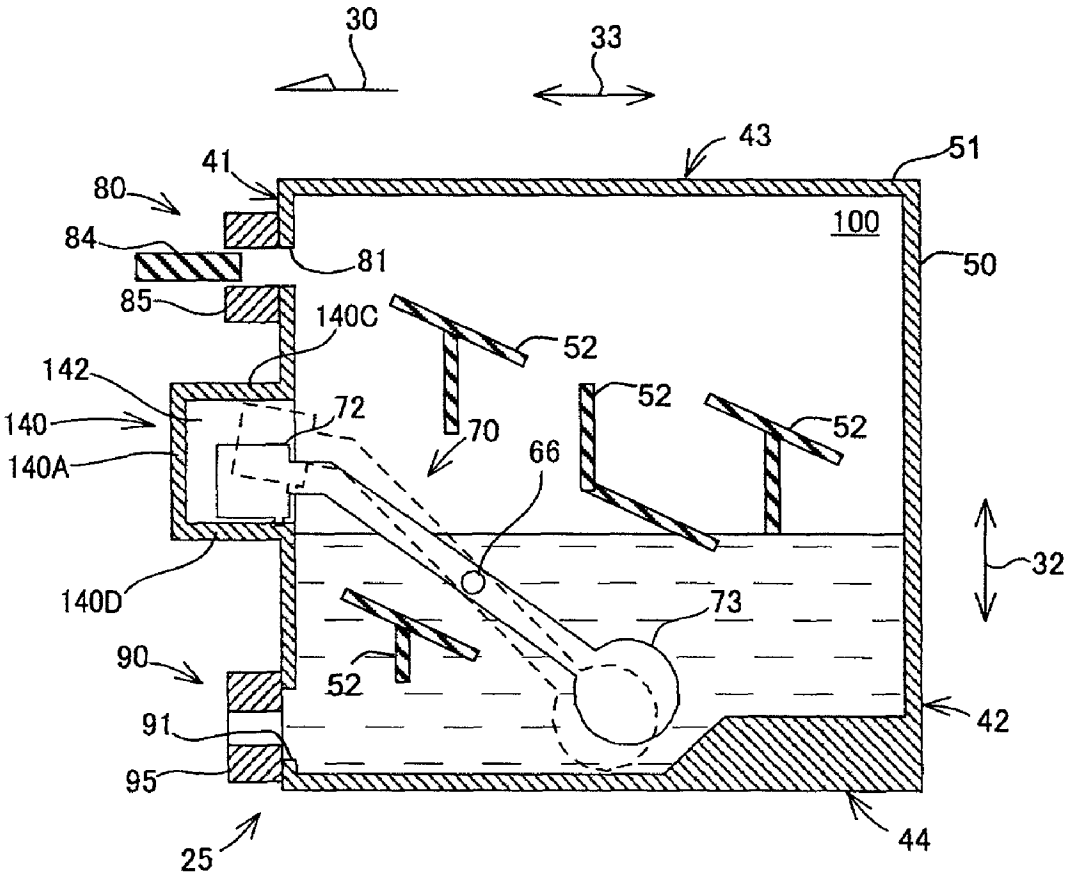
FIG. 3(B) is a side, cross-sectional view of the ink tank of FIGS. 2(A) and 2(B).
Figure 3A:
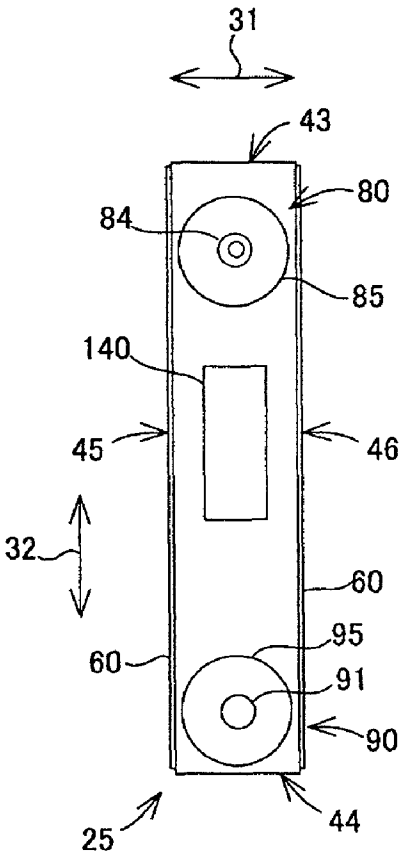
FIG. 3(A) is a front view of the ink tank of FIGS. 2(A) and 2(B)

An air communication portion 80 may be positioned at front outer face 41. When ink tank 25 is mounted to recording apparatus 250, air communication portion 80 may be positioned above detection portion 140. Air communication portion 80 may have an opening 81 formed through front outer face 41 to draw air into ink chamber 100, a valve mechanism configured to selectively open and close opening 81 to selectively allow and prevent fluid communication between an interior and an exterior of ink chamber 100, and a cap 85 enclosing the valve mechanism. Cap 85 may be attached to front outer face 41 and may extend outward from front outer face 41 away from ink chamber 100, such that the valve mechanism is positioned adjacent to opening 81. For example, the valve mechanism of air communication portion 80 may be substantially the same as the valve mechanism described in JP-A-2007-144811 or US 2007/0070138 A1. Alternatively, the valve mechanism of air communication portion 80 may comprise a rod 84 extending to an exterior of cap 85. Only rod 84 is shown in FIGS. 3(A) and 3(B), and other portions of the valve mechanism are omitted in FIGS. 3(A) and 3(B). When no external force is applied to the valve mechanism, the valve mechanism closes opening 81, such that fluid communication between the interior and the exterior of ink chamber 100 through opening 81 is prevented. When an external force is applied to rod 84 toward ink chamber 100, rod 84 moves toward ink chamber 100 to cause the valve mechanism to open opening 81, such that fluid communication between the interior and the exterior of ink chamber 100 through opening 81 is allowed.

Figure 8:
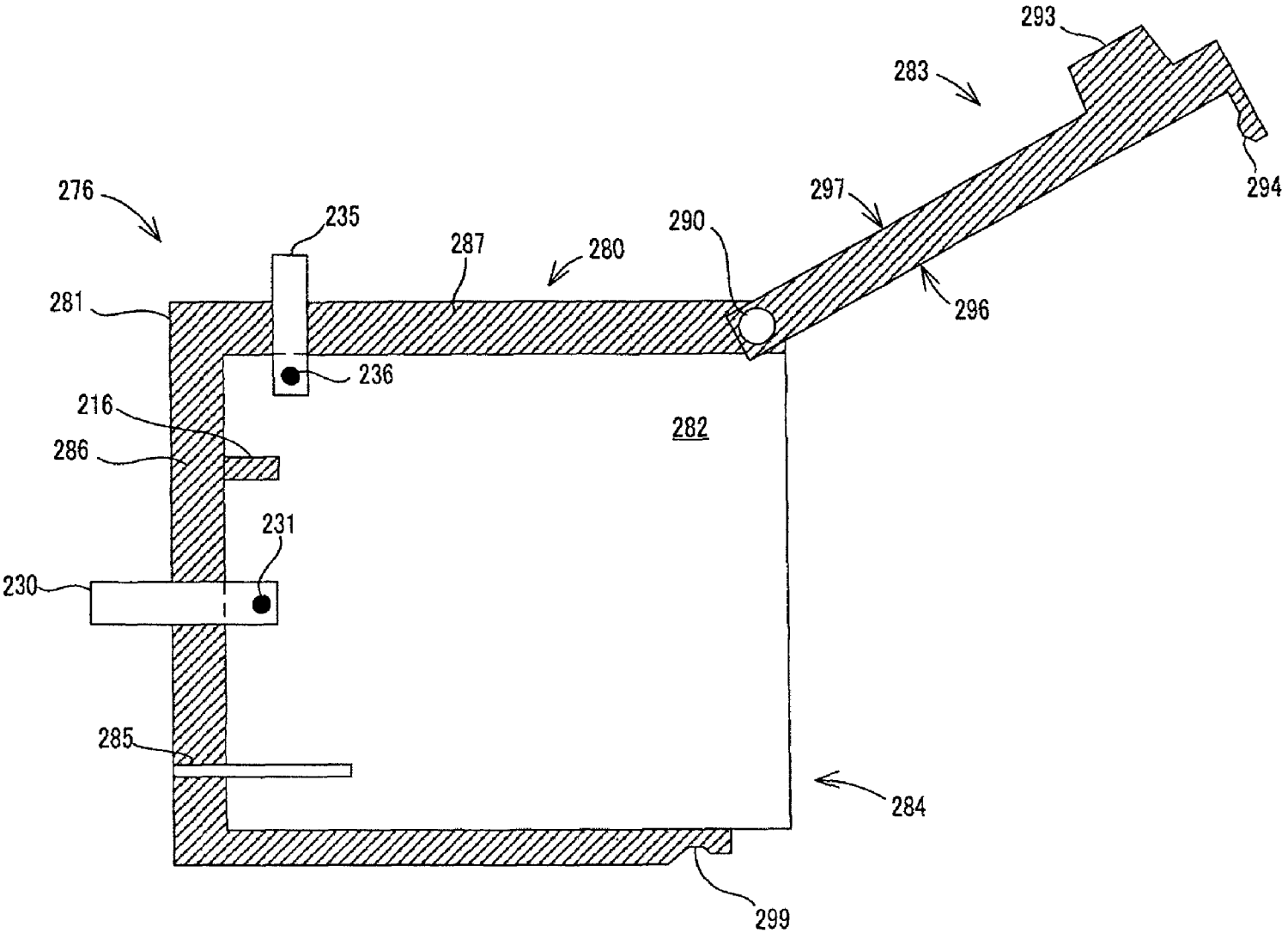
FIG. 8 is a side, partially cross-sectional view of a cartridge mounting portion, according to an embodiment of the present invention.

Ink supply portion 90 may be positioned at front outer face 41. When ink tank 25 is mounted to recording apparatus 250, ink supply portion 90 may be positioned below detection portion 140. Ink supply portion 90 may be an opening 91 formed through front outer face 41 to supply ink from the interior of ink chamber 100 to the exterior of ink chamber 100, a valve mechanism (not shown) configured to selectively open and close opening 91, such that fluid communication between the interior and the exterior of ink chamber 100 through opening 91 is selectively allowed and prevented, and a cap 95 enclosing the valve mechanism. Cap 95 may be attached to front outer face 41 and may extend outward from front outer face 41 away from ink chamber 100, such that the valve mechanism is positioned adjacent to opening 91. For example, the valve mechanism of ink supply portion 90 may be substantially the same as the valve mechanism described in JP-A-2007-144811 or US 2007/0070138 A1. When no external force is applied to the valve mechanism of ink supply portion 90, the valve mechanism may close opening 91, such that fluid communication between the interior and the exterior of ink chamber 100 through opening 91 is prevented. Referring to FIG. 8, cartridge mounting portion 276 may comprise an ink pipe 285, and when ink pipe 285 enters cap 95 and applies a force to, e.g., pushes the valve mechanism toward ink chamber 100, the valve mechanism may open opening 91, such that ink is supplied from ink chamber 100 to recording head 272 through ink pipe 285 and flexible tube 278.

Figure 4:
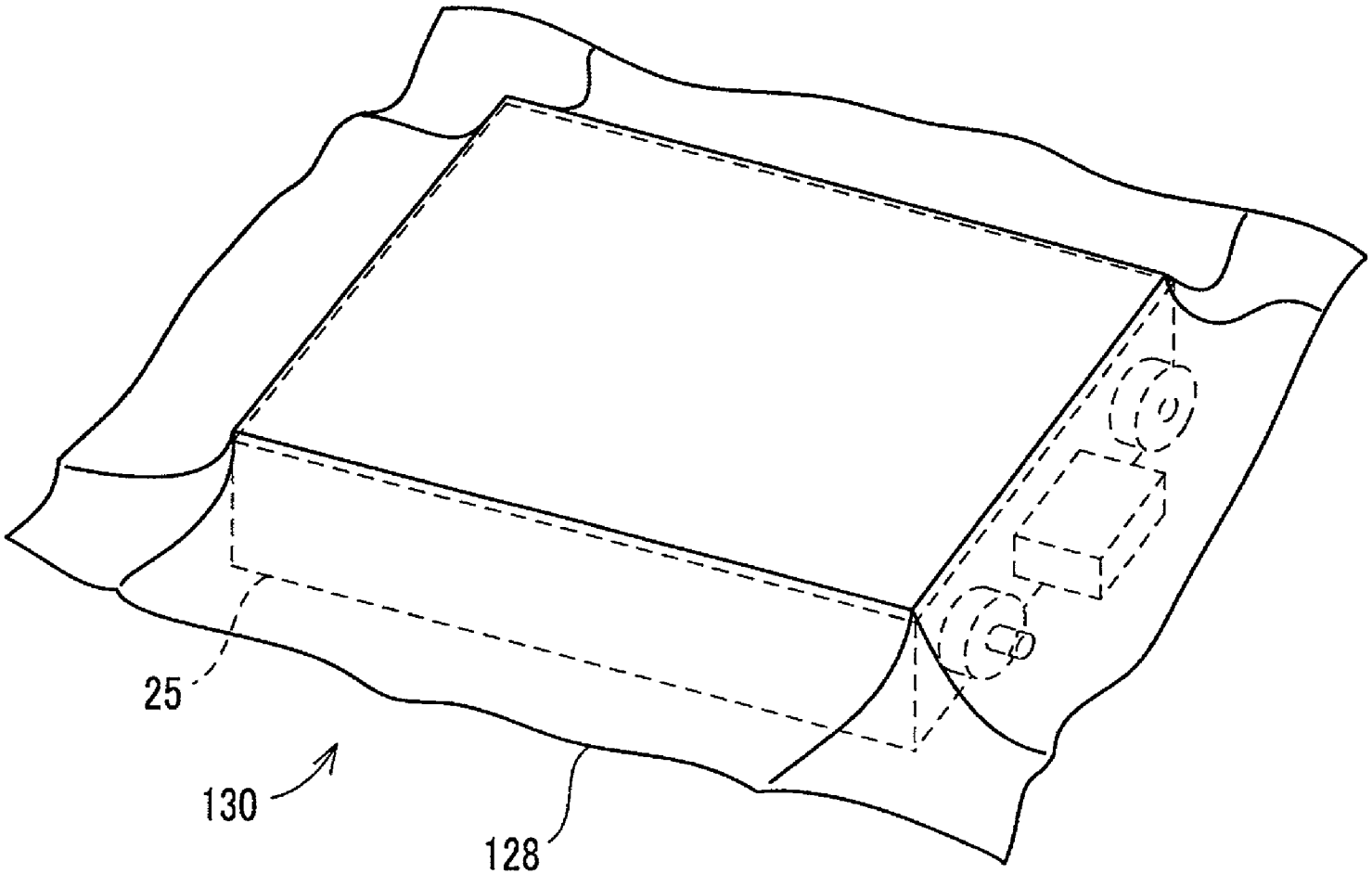
FIG. 4 is a perspective view of a packaging arrangement, according to an embodiment of the present invention.

Referring to FIG. 4, a packaging arrangement 130 according to an embodiment of the present invention may comprise ink tank 25 and packaging bag 128 enclosing ink tank 25 therein. Packaging bag 128 may be impervious to liquid and gas. After ink tank 25 is manufactured, ink tank 25 may be positioned in packaging bag 128. Although adapter 27 is used with ink tank 25 in cartridge mounting portion 276, adapter 27 is not enclosed in packaging bag 128 with ink tank 25.

Packaging bag 128 may comprise a flexible film which substantially is impervious to at least ink and air, and the film may be translucent, e.g., transparent or semi-transparent such that an interior of packaging bag 128 may be viewed from an exterior of packaging bag 128. Although packaging bag 128 substantially is impervious to air, it may be difficult to completely prevent air from passing therethrough. Nevertheless, the amount of air passing through packaging bag 128 may be negligible. Packaging bag 128 may comprise a resin film, e.g., a polyethylene terephthalate film, and an aluminum foil deposited on the resin film by evaporation.

Packaging arrangement 130 may be manufactured, as follows. Ink tank 25 may be inserted into packaging bag 128 through an opening of packaging bag 128, and then a portion of the opening of the packaging bag 128 may be closed by adhering the edge of the opening, such that another portion of the opening is not closed. Then, the suction tube of the decompression device may be inserted into the packaging bag 128 through the unclosed portion of the opening, and the decompression device may be activated to remove air from the packaging bag 128. Then, the suction tube may be removed, and the unclosed portion of the opening may be closed by adhering the edge of the unclosed portion of the opening, such that the interior of packaging bag 128 is maintained under a lower pressure than the atmospheric pressure, e.g., between −90 kPa and −45 kPa. Ink stored in ink chamber 100 may be deaerated, and the interior of ink chamber 100 may be depressurized. Because the interior of packaging bag 128 is depressurized, the pressure in ink chamber 100 may be prevented from increasing to be equal to the atmospheric pressure when the ink tank 25 is not consumed for a substantial amount of time.

Figure 2B:
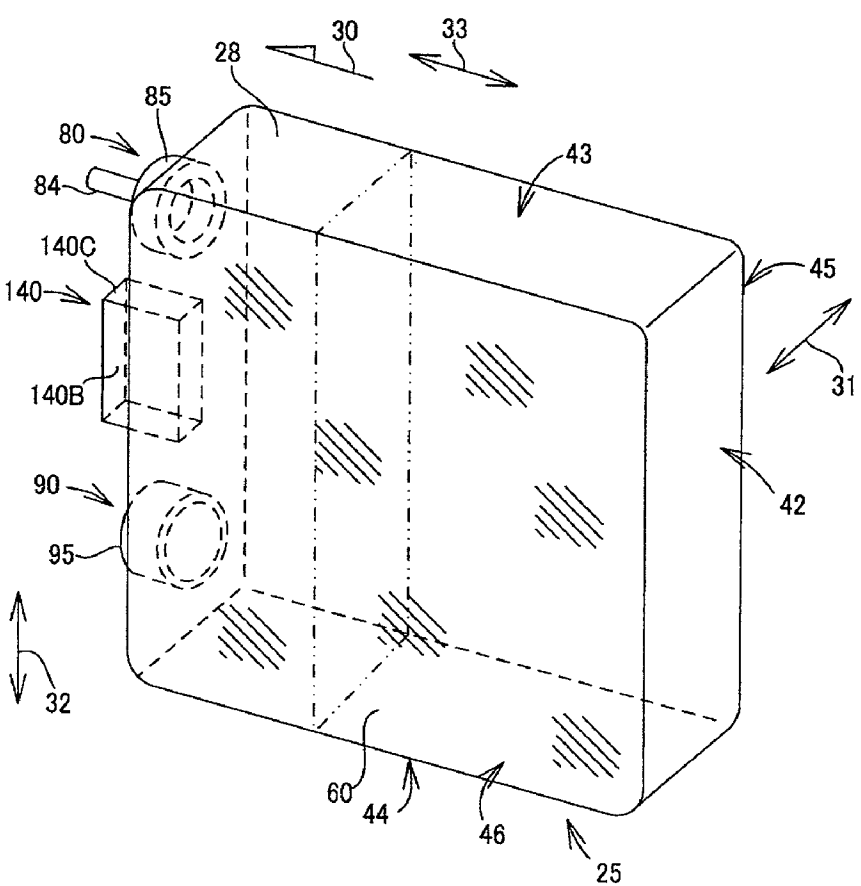
FIGS. 2(A) and 2(B) are perspective views of an ink tank, according to an embodiment of the present invention.
Figure 2A:
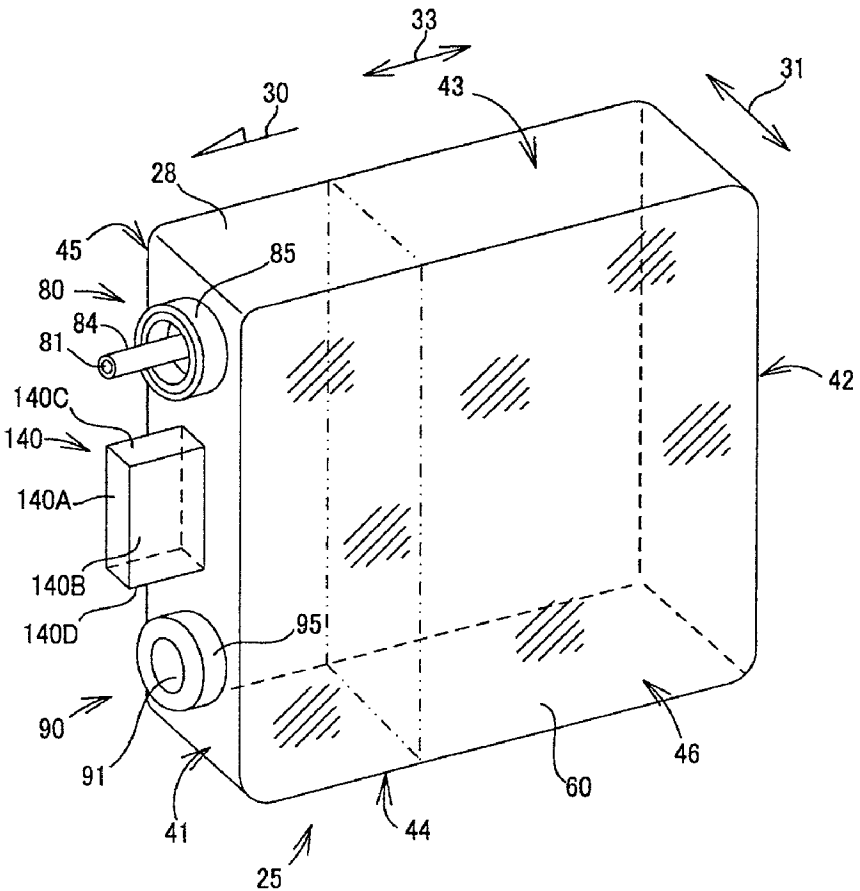
Figure 5:
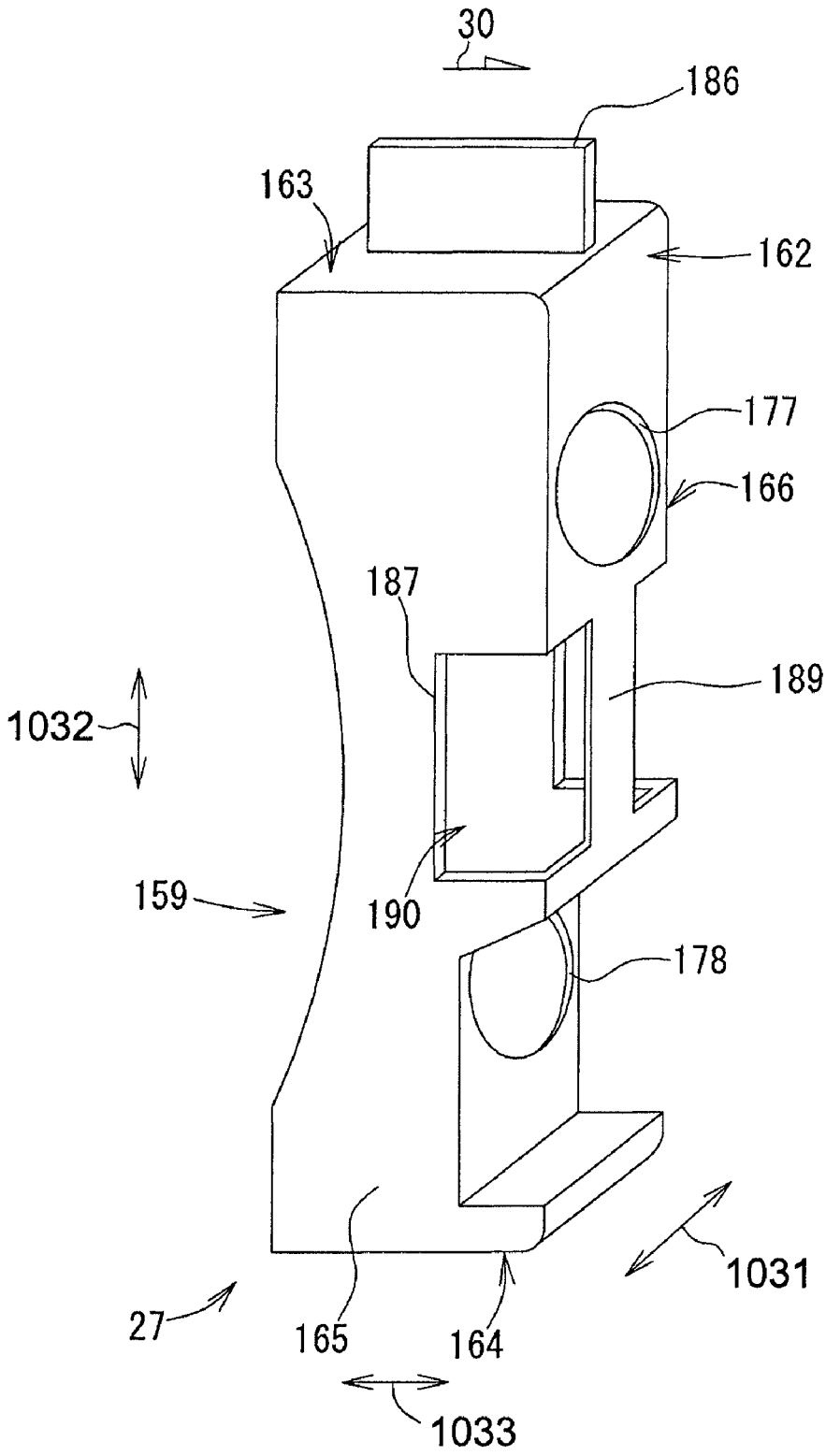
FIG. 5 is a perspective view of an adapter, according to an embodiment of the present invention.
Figure 6:
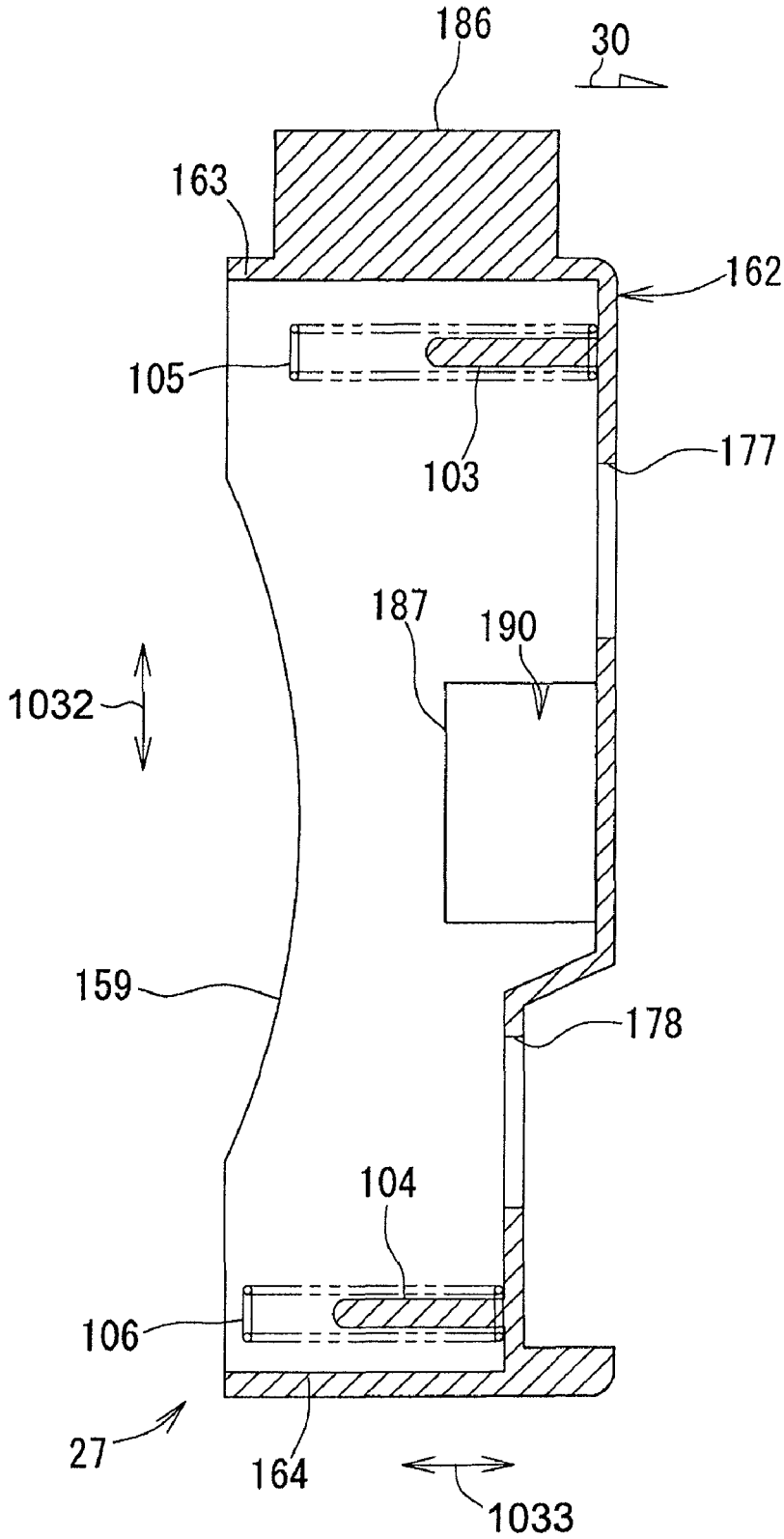
FIG. 6 is a side, cross-sectional view of the adapter of FIG. 5.

Referring to FIGS. 5 and 6, adapter 27 according to an embodiment of the present invention is depicted. Adapter 27 may be used with ink tank 25 in cartridge mounting portion 276. Referring to FIGS. 2(A) and 2(B), ink tank 25 may comprise a front portion 28 positioned between front outer face 41 and a particular portion indicated by an alternating long and two short dashes line. Front portion 28 may comprise air communication portion 80, detection portion 140, and ink supply portion 90. Referring again to FIG. 5, adapter 27 may have a container shape configured to accommodate front portion 28 of ink tank 25. In another embodiment, adapter 27 may accommodate substantially the entirety of ink tank 25.

Adapter 27 may have a substantially rectangular, parallelepiped shape corresponding to the shape of front portion 28 of ink tank 25. Adapter 27 may have a width in a width direction, as indicated by an arrow 1031, a height in a height direction, as indicated by an arrow 1032, and a depth in a depth direction, as indicated by an arrow 1033. The height of adapter 27 may be greater than each of the width and the depth of adapter 27. Adapter 27 may comprise a front wall 162, a top wall 163, a bottom wall 164 opposite top wall 163, a left side wall 165, and a right side wall 166 opposite left side wall 165. Each of top wall 163 and bottom wall 164 may be connected to front wall 162, and each of left side wall 165 and right side wall 166 may be connected to front wall 162, top wall 163, and bottom wall 164. Adapter 27 may have an opening 159 formed opposite front wall 162, and opening 159 may be defined by ends of top wall 163, bottom wall 164, left side wall 165, and right side wall 166. Front wall 162, top wall 163, bottom wall 164, left side wall 165, and right side wall 166 may define a space therein, and the space may be opened to an exterior of adapter 27 via opening 159. Front portion 28 of ink tank 25 may be inserted into the space of adapter 27 via opening 159. When front portion 28 is accommodated in the space of adapter 27, front wall 162 faces front outer face 41 and covers at least a portion of front outer face 41, top wall 163 faces top outer face 43 and covers at least a portion of top outer face 43, bottom wall 164 faces bottom outer face 44 and covers at least a portion of bottom outer face 44, left side wall 165 faces left side outer face 45 and covers at least a portion of left side outer face 45, and right side wall 166 faces right side outer face 46 and covers at least a portion of right side outer face 46. When front portion 28 of ink tank 25 is inserted into the space of adapter 27, the insertion of front portion 28 may be guided by inner surfaces of top wall 163, bottom wall 164, left side wall 165, and right side wall 166, such that ink tank 25 may be smoothly inserted. Adapter 27 is inserted into cartridge mounting portion 276 from front wall 162 side in insertion direction 30. When adapter 27 and ink tank 25 are mounted to cartridge mounting portion 276, width direction 1031, height direction 1032, and depth direction 1033 may be parallel to width direction 31, height direction 32, and depth direction 33, respectively.

Adapter 27 may comprise an opaque material. Adapter 27 may be manufactured by injection-molding a resin, e.g., nylon, polyethylene, polypropylene, polycarbonate, polyolefin, acrylonitrile butadiene styrene, or the like. A coloring agent, e.g., carbon black, may be added in the resin. Adapter 27 has a thickness extending from an outer face of adapter 27 to an inner face of adapter 27 in a direction perpendicular to the outer face and the inner face of adapter 27. In an embodiment, the thickness of adapter 27 is about 0.7 millimeters. Therefore, the thickness of adapter 27 may have less than the thickness of frame 50.

Because the thickness of adapter 27 may be less than the thickness of frame 50, the rigidity of adapter 27 may be less than the rigidity of frame 50. In particular, the rigidity of each of left side wall 165 and right side wall 166 may be relatively low at the end thereof defining opening 159. Because adapter 27 is configured to accommodate front portion 28 of ink tank 25 in the space of adapter 27, adapter 27 may not have walls or ribs to reinforce the rigidity of adapter 27 in the space.

Adapter 27 may have a cut-out 187 formed though front wall 162, left side wall 165, and right side wall 166. When ink tank 25 is accommodated in adapter 27, detection portion 140 may be exposed to the exterior of adapter 27 via cut-out 187. Therefore, cut-out 187 may be formed at a position corresponding to front wall 140A and pair of side walls 140B, and may be a shape and a size corresponding to front wall 140A and pair of side walls 140B. A shape of cut-out 187 at front wall 162 seen from a direction perpendicular to front wall 162 may be rectangular, a shape of cut-out 187 at left side wall 165 seen from a direction perpendicular to left side wall 165 may be rectangular, and a shape of cut-out 187 at right side wall 166 seen from a direction perpendicular to right side wall 166 may be also rectangular.

Adapter 27 may comprise a detection portion 186 positioned at top wall 163. Detection portion 186 may extend from top wall 163 in a direction perpendicular to top wall 163. Detection portion 186 may have a plate shape having a depth in depth direction 1033, a height in height direction 1032, and a width in width direction 1031, in which the height of protrusion 163 is greater than the width of protrusion 163, and the depth of protrusion 163 is greater than the height of protrusion 163. When adapter 27 is inserted into cartridge mounting portion 276, detection portion 186 may be positioned in an optical path 236 of an optical sensor 235 provided in cartridge mounting portion 276. Optical path 236 may be formed between a light emitting portion and a light receiving portion of optical sensor 235. The light emitting portion and the light receiving portion of optical sensor 235 may face each other. Because adapter 27 may comprise an opaque material, detection portion 186 may block light, e.g., visible or infrared light, from passing therethrough. For example, when detection portion 186 is positioned in optical path 236 of optical sensor 235, detection portion 186 may prevent the light of optical sensor 235 from passing therethrough or may alter the path of the light. Alternatively, adapter 27 may comprise a reflective member, e.g., aluminum foil, positioned at detection portion 186, and when detection portion 186 receives light emitted from optical sensor 235, detection portion 186 reflects the light. In another embodiment detection portion 186 may reduce the intensity of light passing therethrough. The rigidity of detection portion 186 in width direction 1031 may be less than the rigidity of frame 50 in width direction 31, and detection portion 186 may bend in width direction 1031 when an external force is applied to detection portion 186.

Adapter 27 may comprise a bridge portion 189 positioned at front wall 162 and spanning cut-out 187 in height direction 1032. Bridge portion 189 may have a plate shape having a depth in depth direction 1033, a height in height direction 1032, and a width in width direction 1031, in which the width of bridge portion 189 is greater than the depth of bridge portion 189, and the height of bridge portion 189 is greater than the width of bridge portion 189. Bridge portion 189 may divide cut-out 187 into two openings 190. When bridge portion 189 is inserted into cartridge mounting portion 276, bridge portion 189 passes an optical path 231 of optical sensor 230. Optical path 231 may be formed between a light emitting portion and a light receiving portion of optical sensor 230. The light emitting portion and the light receiving portion of optical sensor 230 may face each other. Because adapter 27 may comprise an opaque material, bridge portion 189 may block light, e.g., visible or infrared light, emitted from the light emitting portion. When bridge portion 189 is positioned in optical path 231 of optical sensor 230, bridge portion 189 may prevent the light of optical sensor 230 from passing therethrough or may alter the path of the light. Alternatively, adapter 27 may comprise a reflective member, e.g., aluminum foil, positioned at bridge portion 189, and when bridge portion 189 receives light emitted from optical sensor 230, bridge portion 189 reflects the light. In another embodiment, bridge portion 189 may reduce the intensity of light passing therethrough. When the insertion of adapter 27 into the cartridge mounting portion 276 is complete, the light emitting portion and the light receiving portion of optical sensor 230 faces openings 190, respectively, such that the light emitted from the light emitting portion may reach the light receiving portion though openings 190. The depth of bridge portion 189 may depend on an initial amount of ink stored in ink chamber 100 of ink tank 25 which is used with adapter 27. In an embodiment, two types of ink tank 25 are used. One type of ink tank 25 stores a relatively small initial amount of ink in ink chamber 100, and another type of ink tank 25 stores a relatively large initial amount of ink in ink chamber 100. The depth of bridge portion 189 of adapter 27 used with ink tank 25 storing the relatively large initial amount of ink may be greater than the depth of bridge portion 189 of adapter 27 used with ink tank 25 storing the relatively small initial amount of ink.

Front wall 162 may have a circular opening 177 formed therethrough. Opening 177 may be positioned adjacent to top wall 163. The space defined by front wall 162, top wall 163, bottom wall 164, left side wall 165, and right side wall 166 may be opened to the exterior of adapter 27 via opening 177. Opening 177 may be formed at a position corresponding to air communication portion 80. Referring to FIG. 8, cartridge mounting portion 276 comprises a pushing portion 216, and the diameter of opening 177 may be sufficient to allow pushing portion 216 to be inserted through opening 177. When adapter 27 is mounted to cartridge mounting portion 276, pushing portion 216 is positioned in opening 177. Then, when ink tank 25 is inserted into cartridge mounting portion 276, pushing portion 216 applies a force to rod 84, e.g., pushes rod 84 toward ink chamber 100, to cause the valve mechanism of air communication portion 80 to open opening 81.

Referring again to FIG. 5, front wall 162 has a circular opening 178 formed through front wall 162. Opening 178 may be positioned adjacent to bottom wall 164. The space defined by front wall 162, top wall 163, bottom wall 164, left side wall 165, and right side wall 166 may be opened to the exterior of adapter 27 via opening 178. Opening 178 may be formed at a position corresponding to ink supply portion 90. The diameter of opening 178 may be sufficient to allow ink supply portion 90 to be inserted through opening 178. When adapter 27 is mounted to cartridge mounting portion 276, and then ink tank 25 may be inserted into cartridge mounting portion 276, ink supply portion 90 passes through opening 178, such that ink supply portion 90 is positioned in opening 178 adapter 27, and ink pipe 285 is positioned in ink supply portion 90.

Referring to FIG. 6, adapter 27 may comprise a support bar 103 extending from the inner surface of front wall 162 into the space of adapter 27 in depth direction 1033, and support bar 103 may be positioned between top wall 163 and opening 177. Adapter 27 also may comprise a support bar 104 extending from the inner surface of front wall 162 into the space of adapter 27 in depth direction 1033, and support bar 104 may be positioned between bottom wall 164 and opening 178. Adapter 27 may comprise coil springs 105 and 106 positioned in the space of adapter 27, and coil springs 105 and 106 may be supported by support bars 103 and 104 respectively, such that coil springs 105 and 106 expand and contract in depth direction 1033. Coil springs 105 and 106 may be replaced with leaf springs or rubber springs.

Figure 13:
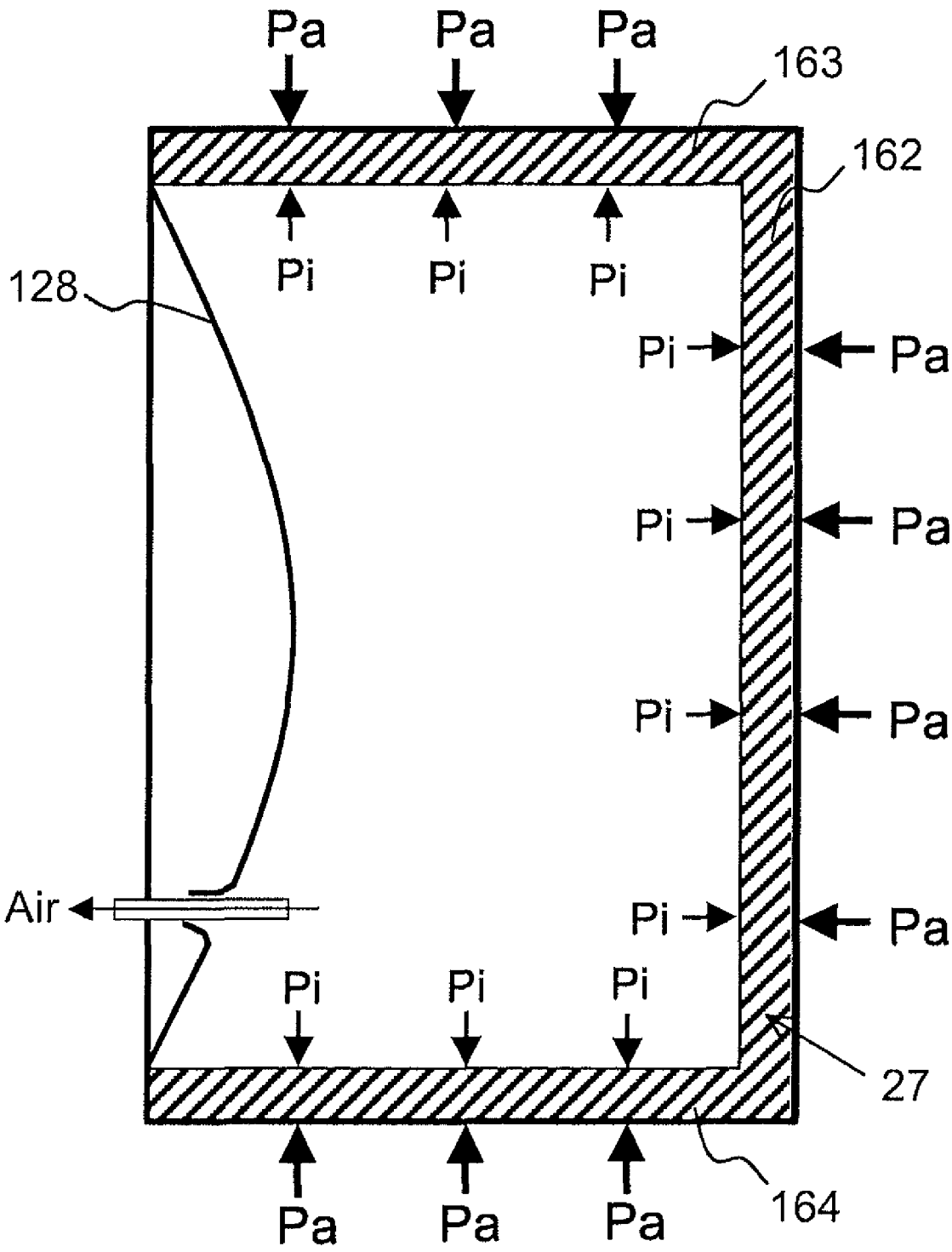
FIG. 13 is a simplified, cross sectional, side view of the adapter of FIG. 5, in which the adapter is positioned in a packaging bag, and the interior of the packaging bag is depressurized.

Referring to FIG. 13, if adapter 27 were enclosed in packaging bag 128, and the interior of packaging bag 128 were depressurized, front wall 162, top wall 163, bottom wall 164, left side wall 165, and right side wall 166 would bend into the space defined by front wall 162, top wall 163, bottom wall 164, left side wall 165, and right side wall 166 because the atmospheric pressure Pa would act on outer surface of front wall 162, top wall 163, bottom wall 164, left side wall 165, and right side wall 166 via packaging bag 128 while the pressure Pi in the space defined by front wall 162, top wall 163, bottom wall 164, left side wall 165, and right side wall 166 is less than the atmospheric pressure Pa. Because the area of each of left side wall 165 and right side wall 166 may be greater than the area of each of front wall 162, top wall 163, and bottom wall 164, left side wall 165 and right side wall 166 would be more likely to bend. Moreover, because the rigidity of detection portion 186 and the rigidity of bridge portion 189 may be less than the rigidity of frame 50, detection portion 186 would bend in width direction 1031, and bridge portion 189 would bend into cut-out 187. Moreover, because front wall 162 has openings 177, 178, and 190, the rigidity of front wall 162 may be less than the rigidity of frame 50. Therefore, portions surrounding opening 177, opening 178, and openings 190, respectively, would bend into the space defined by front wall 162, top wall 163, bottom wall 164, left side wall 165, and right side wall 166. As such, when the atmospheric pressure acted on one surface of a particular portion of adapter 27 via packaging bag 128 while the pressure less than the atmospheric acted on the opposite surface of the portion of adapter 27, the particular portion of adapter 27 would bend, and the particular portion of adapter 27 might not return to its original shape. Therefore, adapter 27 is not enclosed in packaging bag 128.

Figure 7:
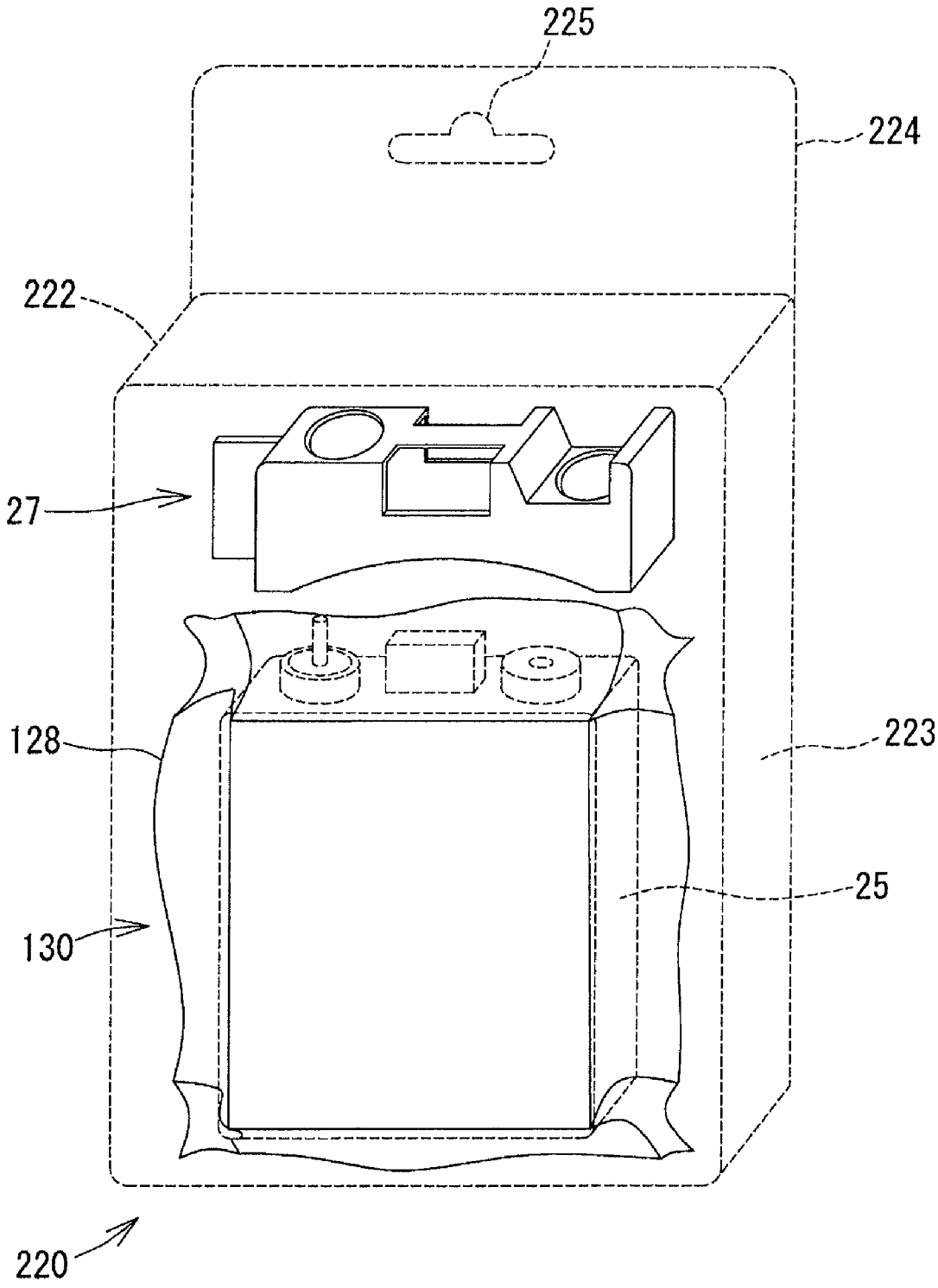
FIG. 7 is a perspective view of a container arrangement, according to an embodiment of the present invention.

Referring to FIG. 7, a container arrangement 220 according to an embodiment of the present invention may comprise packaging arrangement 130, adapter 27, and a container 222, e.g., a paper, box-shaped container 222 enclosing packaging arrangement 130 and adapter 27. Container 222 may comprise a containing portion 223 and a hanger portion 224. Hanger portion 224 may be an opening 225 formed therethrough. Packaging arrangement 130 and adapter 27 may be enclosed in container 222, and container arrangement 220 may be shipped from a factory. Container arrangement 220 may be displayed at a display rack in a store with a bar extending from the display rack being positioned in opening 225 to suspend container arrangement 220 from the bar. Containing portion 223 may have a substantially rectangular, parallelepiped shape, and may be configured to enclose packaging arrangement 130 and adapter 27. Because container arrangement 220 is shipped and displayed while ink tank 25 is enclosed under lower pressure and adapter 27 is under the atmospheric pressure in container 222, leakage of ink from container 222 is prevented, and deformation of adapter 27 is prevented. Moreover, if ink chamber 100 is depressurized, the pressure in ink chamber 100 may be prevented from increasing to the atmospheric pressure. In another embodiment, container 222 may comprise some material other than paper, and container 222 may be a bag other than a box.

Referring to FIGS. 8-12, cartridge mounting portion 276 according to an embodiment of the present invention is depicted. Cartridge mounting portion 276 may comprise at least one case 280, e.g., four cases 280, corresponding to four ink tanks 25, respectively. Case 280 comprises a main body 281 and a lock lever 283. Main body 281 may have an accommodating chamber 282 formed therein. Accommodating chamber 282 may be configured to receive and accommodate ink tank 25 and adapter 27. Case 280 may have an opening 284 formed therethrough, and an end wall 286 positioned opposite opening 284. Adapter 27 may be inserted into accommodating chamber 282 via opening 284 to contact end wall 286, and then ink tank 25 may be inserted into accommodating chamber 282 via opening 284, such that front portion 28 of ink tank 25 is positioned in adapter 27.

Case 280 may comprise optical sensor 230 and optical sensor 235, e.g., photo interrupters. Optical sensor 230 may be positioned at end wall 286 of case 280. Case 280 may comprise a top wall 287, and optical sensor 235 may be positioned at top wall 287 adjacent to end wall 286. Each of optical sensor 230 and optical sensor 235 may comprise a light emitting portion and a light receiving portion. Each of optical sensor 230 and optical sensor 235 may be coupled to a controller (not shown) of recording apparatus 250, and may be configured to output an electric signal to the controller when the light receiving portion receives at least a predetermined amount of the light emitted from the light emitting portion, and to not output the electric signal to the controller when the light receiving portion does not receive at least the predetermined amount of the light emitted from the light emitting portion. Optical path 231 may be formed between a light emitting portion and a light receiving portion of optical sensor 230. The light emitting portion and the light receiving portion of optical sensor 230 may be aligned in a direction perpendicular to the paper plane of FIG. 8, and the light emitting portion and the light receiving portion of optical sensor 230 may face each other. Similarly, optical path 236 may be formed between a light emitting portion and a light receiving portion of optical sensor 235. The light emitting portion and the light receiving portion of optical sensor 235 may be aligned in a direction perpendicular to the paper plane of FIG. 8, and the light emitting portion and the light receiving portion of optical sensor 235 may face each other.

When bridge portion 189 or indication portion 72 is positioned in optical path 231, the light receiving portion of optical sensor 230 does not receive at least the predetermined amount of the light emitted from the light emitting portion of optical sensor 230. When detection portion 186 is positioned in optical path 236, the light receiving portion of optical sensor 235 does not receive at least the predetermined amount of the light emitted from the light emitting portion of optical sensor 235.

Case 280 may comprise ink pipe 285 extending from end wall 286 toward opening 284 in a direction opposite insertion direction 30. Ink pipe 285 may penetrate through end wall 286, and an end of ink pipe 285 may be exposed to the exterior of main body 281. Flexible tube 278 may be connected to the end of ink pipe 285. When ink tank 25 is accommodated in accommodating chamber 282, ink pipe 285 enters ink supply portion 90, and the valve mechanism of ink supply portion 90 moves to open opening 91. When the valve mechanism of ink supply portion 90 opens opening 91, ink chamber 100 is brought into fluid communication with ink pipe 285, and ink is supplied from ink chamber 100 to recording head 272 via opening 91, ink pipe 285, and flexible tube 278.

Case 280 may comprise pushing portion 216 extending from end wall 286 toward opening 284 in a direction opposite insertion direction 30. When adapter 27 is inserted into accommodating chamber 282, pushing portion 216 is inserted through opening 177. Then, when ink tank 25 is inserted into accommodating chamber 282, pushing portion 216 applies a force to rod 84, e.g., pushes rod 84 toward ink chamber 100, to cause the valve mechanism of air communication portion 80 to open opening 81.

Lock lever 283 may be configured to be selectively opened and closed to selectively cover and uncover opening 284. When adapter 27 and ink tank 25 are accommodated in accommodating chamber 282, and lock lever 283 is closed, adapter 27 and ink tank 25 are securely retained in accommodating chamber 282 by lock lever 283. Case 280 may comprise a shaft 290 positioned directly above opening 284, and a first end of lock lever 283 is coupled to shaft 290, such that lock lever 283 pivots about shaft 290. Lock lever 290 has an inner surface 296 and an outer surface 297 opposite inner surface 296. When lock lever 290 covers opening 284, inner surface 296 faces accommodating chamber 282. Lock lever 283 may comprise an operation portion 293 and a claw 294. Claw 294 may be positioned at inner surface 296 and at a second end of lock lever 283 opposite the first end of lock lever 283. Operation portion 293 may be positioned at outer surface 297 adjacent to the second end of lock lever 283. Case 280 may have a groove 299 formed therein at a position below opening 284, and groove 299 may be configured to engage claw 294.

Referring to FIGS. 9-12, adapter 27 and ink tank 25 may be inserted into accommodating chamber 282 and mounted to case 280 in the following manner.

Figure 9:
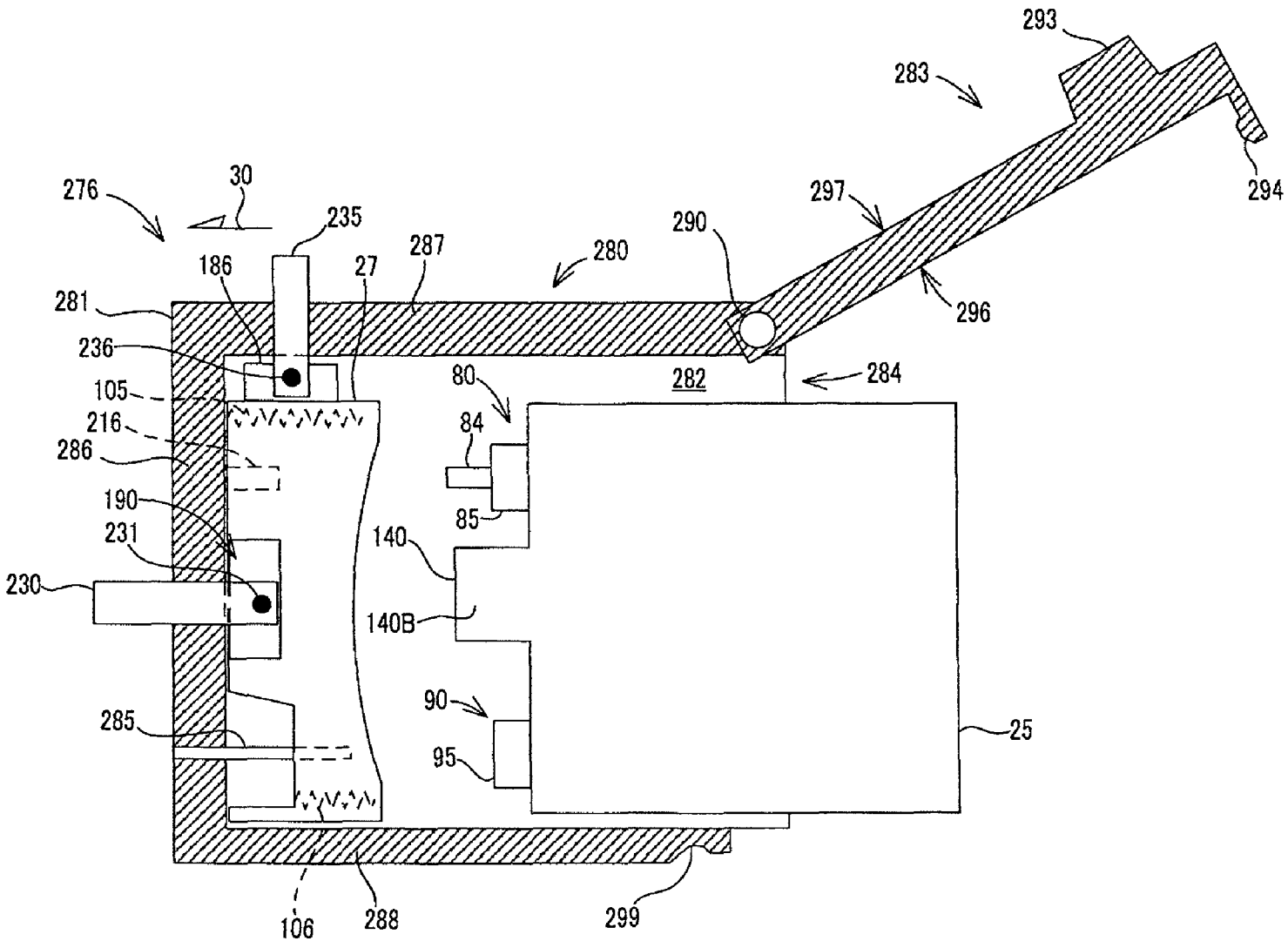
FIG. 9 is a side, partial cross-sectional view of the cartridge mounting portion of FIG. 8, the adapter of FIG. 5, and the ink tank of FIGS. 2(A) and 2(B), in which the insertion of the adapter into the cartridge mounting portion is complete, and ink tank is being inserted into cartridge mounting portion.

Adapter 27 may be inserted into accommodating chamber 282 from the front wall 162 side via opening 284 toward end wall 286. Bridge portion 189 first enters optical path 231 of optical sensor 230, and then when adapter 27 is further inserted, detection portion 186 enters optical path 236 of optical sensor 235. If adapter 27 is the adapter used with ink tank 25 storing the relatively large initial amount of ink, the depth of bridge portion 189 may be sufficient enough that bridge portion 189 still is positioned in optical path 231 of optical sensor 230 when detection portion 186 initially enters optical path 236 of optical sensor 235. In contrast, if adapter 27 is the adapter used with ink tank 25 storing the relatively small initial amount of ink, the depth of bridge portion 189 may be short enough that bridge portion 189 has passed optical path 231 of optical sensor 230 and is not positioned in optical path 231 of optical sensor 230 when detection portion 186 initially enters optical path 236 of optical sensor 235. The controller may determine which type of ink tank 25 is mounted based on the output of optical sensor 230 when detection portion 186 initially enters optical path 236 of optical sensor 235. When adapter 27 is further inserted, adapter 27 contacts end wall 286, which completes the insertion of adapter 27. When adapter 27 contacts end wall 286, detection portion 186 is positioned in optical path 236 of optical sensor 235, and optical path 231 of optical sensor 230 is positioned through openings 190, as shown in FIG. 9. The controller determines whether adapter 27 is mounted in case 280 based on the output of optical sensor 235.

Figure 10:
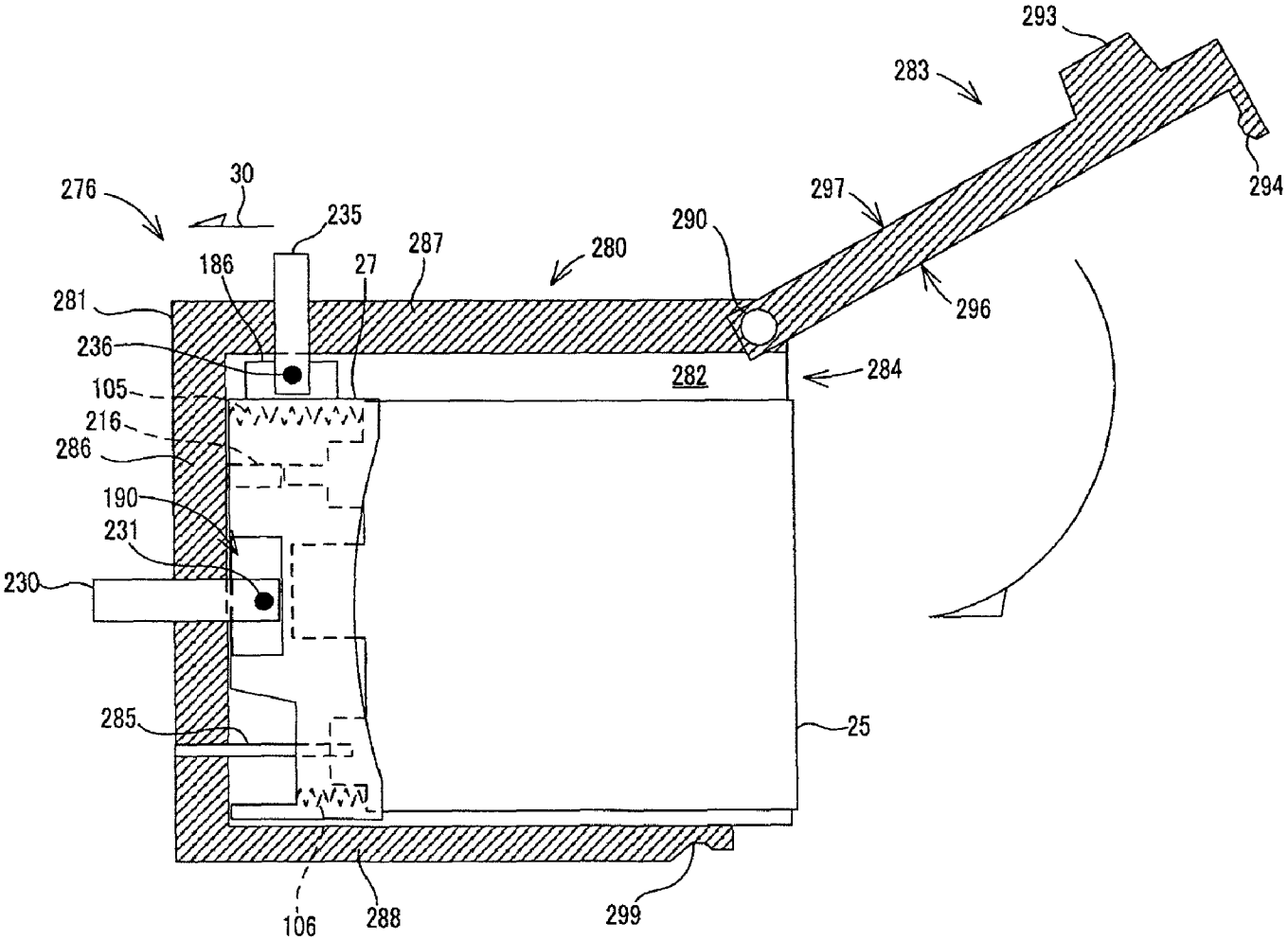
FIG. 10 is a side, partial cross-sectional view of the cartridge mounting portion of FIG. 8, the adapter of FIG. 5, and the ink tank of FIGS. 2(A) and 2(B), in which the insertion of the adapter into the cartridge mounting portion is completed, and the ink tank is further inserted into cartridge mounting portion from the position shown in FIG. 9.
Figure 11:
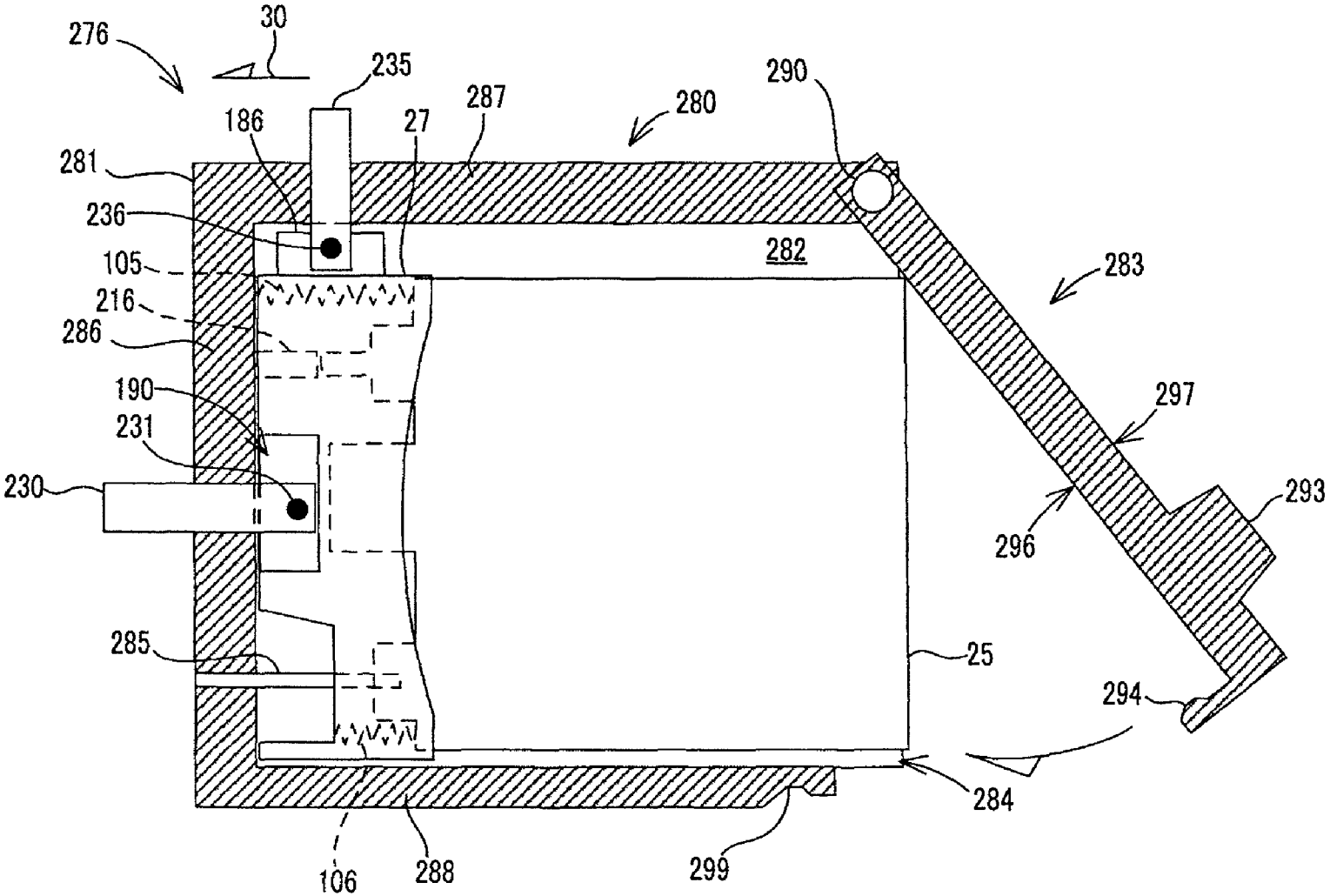
FIG. 11 is a side, partial cross-sectional view of the cartridge mounting portion of FIG. 8, the adapter of FIG. 5, and the ink tank of FIGS. 2(A) and 2(B), in which in which the insertion of the adapter into the cartridge mounting portion is complete, and a lock lever of the cartridge mounting portion is in contact with the ink tank.

Subsequently, ink tank 25, which has been enclosed in container 222 with adapter 27 mounted in case 280, may be inserted into accommodating chamber 282 from the front outer face 41 side via opening 284 toward end wall 286, and then front outer face 41 of ink tank 25 contacts the end of coil springs 105 and 106, respectively, as shown in FIG. 10.

Subsequently, lock lever 283 pivots toward opening 284, and inner surface 296 of lock lever 283 contacts rear outer face 42 of ink tank 25. A user may push operation portion 293 to cause lock lever 283 to pivot. When lock lever 283 further pivots, lock lever 283 pushes ink tank 25 against biasing forces of coil springs 105, 106, respectively, while coil springs 105 and 106 contract, respectively, such that front portion 28 of ink tank 25 is inserted into the space of adapter 27 via opening 159 of adapter 27.

During the insertion of ink tank 25, pushing portion 216 applies a force to rod 84, e.g., pushes rod 84 toward ink chamber 100 to cause the valve mechanism of air communication portion 80 to open opening 81, such that ink chamber 100 is brought into fluid communication with the atmosphere via opening 81. Ink pipe 285 then enters ink supply portion 90, such that the valve mechanism of ink supply portion 90 opens opening 91, such that ink chamber 100 is brought into fluid communication with ink pipe 285, and ink is supplied from ink chamber 100 to recording head 272 via opening 91, ink pipe 285, and flexible tube 278. When ink tank 25 is inserted to the end, detection portion 140 may be exposed to the exterior of adapter 27 via openings 190, and detection portion 140 may be positioned in optical path 231 of optical sensor 230. When indication portion 72 is positioned in optical path 231, the controller of recording apparatus 250 determines that ink chamber 100 has a sufficient amount of ink stored therein, and when indication portion 72 is not positioned in optical path 231, the controller determines that ink chamber 100 does not have a sufficient amount of ink stored therein, based on the output from optical sensor 230.

Figure 12:
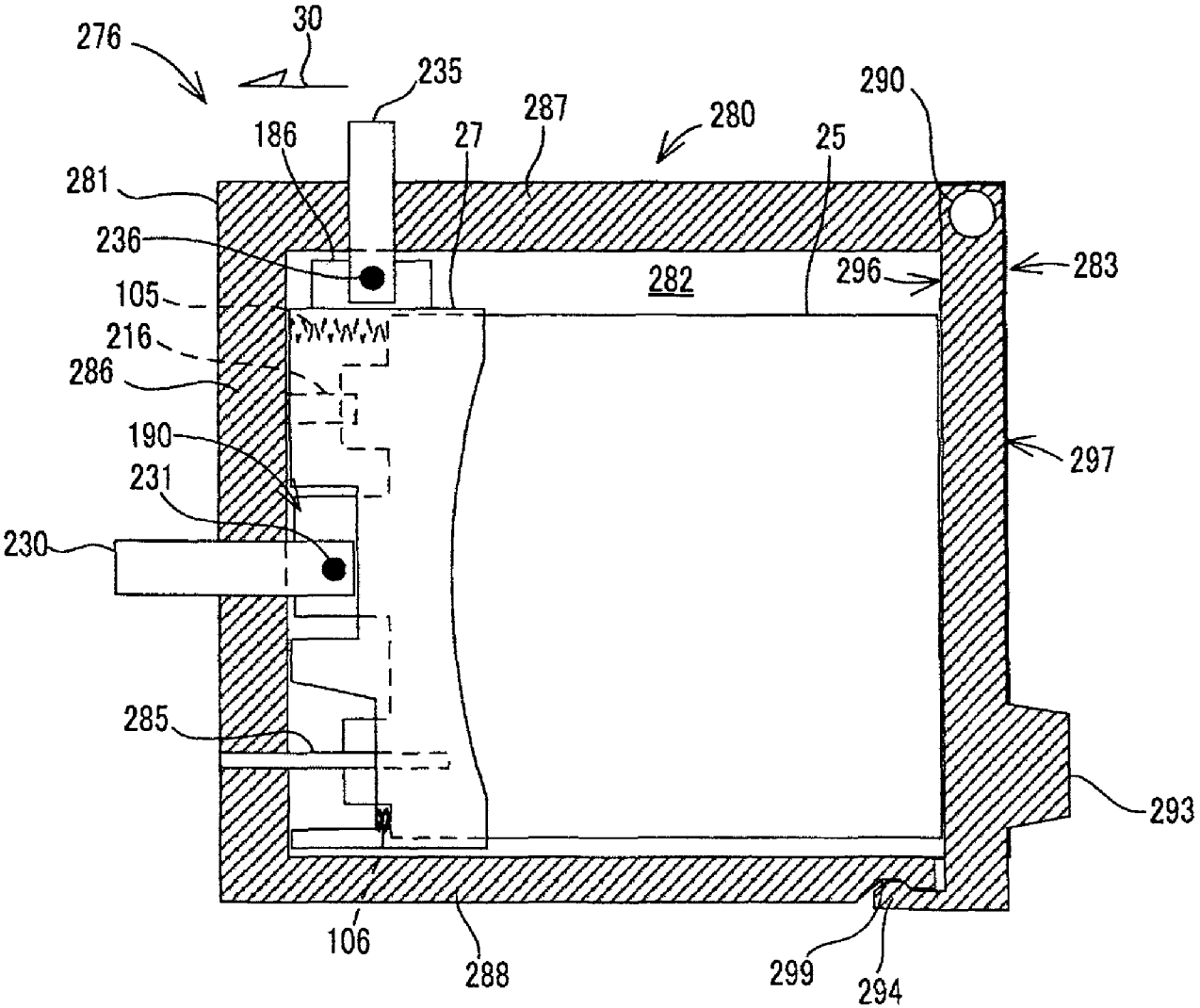
FIG. 12 is a side, partial cross-sectional view of the cartridge mounting portion of FIG. 8, the adapter of FIG. 5, and the ink tank of FIGS. 2(A) and 2(B), in which the insertion of the adapter into the cartridge mounting portion is complete, the insertion of the adapter into the cartridge mounting portion is complete, and the lock lever of the cartridge mounting portion is secured to a case of the cartridge mounting portion.

When the second end of lock lever 283 moves toward groove 299 and claw 294 engages groove 299, that lock lever 283 is closed and secured to main body 281, as shown in FIG. 12. After lock lever 283 is closed, ink tank 25 receives the biasing forces of coil springs 105 and 106 toward opening 284, such that rear outer face 42 contacts inner surface 296 of lock lever 283, and therefore, ink tank 25 is securely retained in case 280.

When ink tank 25 is removed from case 280, claw 294 disengages from groove 299, and lock lever 283 pivots upward. When this occurs, ink tank 25 is pushed toward opening 284 by the biasing forces of coil springs 105 and 106, and ink tank 25 is partially positioned outside case 280. Therefore, a user readily may remove ink tank 25 from case 280 by grasping a rear portion of ink tank 25.

As described above, container arrangement 220 is shipped and displayed while ink tank 25 is packed under lower pressure and adapter 27 is under the atmospheric pressure in container 222, leakage of ink from container 222 is prevented, and deformation of detection portion 186, bridge portion 189, front wall 162, top wall 163, bottom wall 164, left side wall 165, and right side wall 166 of adapter 27 is prevented. Moreover, if ink chamber 100 is depressurized, the pressure in ink chamber 100 may be prevented from increasing to be equal to the atmospheric pressure. In another embodiment, adapter 27 may comprise at least one of detection portion 186, bridge portion 189, front wall 162, top wall 163, bottom wall 164, left side wall 165, and right side wall 166. Even in such a case, if adapter 27 were enclosed in packaging bag 128, and the interior of packaging bag 128 were depressurized, such that the atmospheric pressure acted on one surface of the particular portion of adapter 27 via packaging bag 128 while the pressure less than the atmospheric acted on the opposite surface of the portion of adapter 27, the portion of adapter 27 would bend. Therefore, adapter 27 is not packed in packaging bag 128.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

The invention claimed is:

1. A container arrangement comprising:

a packaging arrangement comprising:

an ink tank with a front side, a rear side, and one or more sides defining an ink chamber therein, wherein the ink chamber is configured to store ink therein; and a packaging bag enclosing the ink tank therein, wherein a pressure of an interior of the packaging bag is less than a pressure of an exterior of the packaging bag;

an adapter configured to be removably coupled to the front side of the ink tank and to couple the ink tank to a cartridge mounting portion of a recording apparatus when inserted into the cartridge mounting portion in an insertion direction, wherein the adapter comprises:

a main body with a front face, a rear face, and at least one other face, wherein the rear face of the main body forms an opening that is configured to receive the ink tank inserted therethrough and the front face of the main body corresponds to the front side of the ink tank when the front side of the ink tank is coupled to the adapter; and a plate shaped portion positioned at the front face of the main body, the plate shaped portion being configured to block light emitted from a light emitting portion in the recording apparatus when the adapter is inserted into the recording apparatus so as to provide an indication of at least one characteristic of the ink that the ink chamber is configured to store; and a container enclosing each of the packaging arrangement and the adapter, wherein the adapter is positioned outside the packaging bag.

2. The container arrangement of claim 1, wherein the ink tank comprises a first member having a first rigidity which is greater than a predetermined rigidity, and the adapter comprises a second member having a second rigidity which is less than the predetermined rigidity.

3. The container arrangement of claim 2, wherein the predetermined rigidity is a rigidity sufficient to maintain a shape of the first member when a predetermined amount of force generated by a pressure differential between the interior of the packaging bag and the exterior of the packaging bag is applied to the first member.

4. The container arrangement of claim 3, wherein the second member has a plate shape.

5. The container arrangement of claim 4, wherein the first member comprises a frame defining a perimeter of the ink chamber.

6. The container arrangement of claim 5, wherein the container has a box shape.

7. The 7 container arrangement of claim 1, wherein the main body opening is configured to receive at least a portion of the ink tank.

8. The container arrangement of claim 7, further comprising at least one resilient member coupled to the adapter, wherein each of the at least one resilient member and the ink tank extend from the adapter in the insertion direction.

9. The container arrangement of claim 1, wherein the ink tank comprises an ink supply portion configured to dispense ink from an interior of the ink chamber to an exterior of the ink chamber, and the adapter has an ink supply opening formed therethrough, wherein when the adapter is coupled to the ink tank, the ink supply opening is configured to receive the ink supply portion therethrough.

10. The container arrangement of claim 9, wherein the ink tank further comprises an air intake portion configured to draw air from the exterior of the ink chamber to the interior of the ink chamber, and the adapter has an air intake opening formed therethrough, wherein when the adapter is coupled to the ink tank, the air intake opening is aligned with the air intake portion in the insertion direction.

11. The container arrangement of claim 1, wherein:

the plate shaped portion is configured to reflect light.

12. The container arrangement of claim 1, wherein:

the plate shaped portion is configured to prevent light from passing therethrough.

13. The container arrangement of claim 1, wherein:

the plate shaped portion extends across an opening in the front face of the main body.

14. The container arrangement of claim 1, wherein:

the plate shaped portion has a depth in the insertion direction; and the depth of the plate shaped portion is what provides an indication of the at least one characteristic of the ink that the ink chamber is configured to store.

* * * * *